US006662703B2

(12) United States Patent
Sullivan

(10) Patent No.: US 6,662,703 B2
(45) Date of Patent: Dec. 16, 2003

(54) OPEN BOLT FIRING MECHANISM FOR PROGRAMMABLE CARTRIDGES

(75) Inventor: Kevin Sullivan, Kennebunk, ME (US)

(73) Assignee: Nammo, Inc., Arlington, VA (US)

( * ) Notice: Subject to any disclaimer, the term of this patent is extended or adjusted under 35 U.S.C. 154(b) by 0 days.

(21) Appl. No.: 10/104,053

(22) Filed: Mar. 25, 2002

(65) Prior Publication Data

US 2003/0047063 A1 Mar. 13, 2003

Related U.S. Application Data

(60) Provisional application No. 60/277,944, filed on Mar. 23, 2001, now abandoned.

(51) Int. Cl.[7] ..... F42C 17/04
(52) U.S. Cl. ..... 89/6.5; 89/199
(58) Field of Search ..... 89/6, 6.5, 195, 89/196, 199

(56) References Cited

U.S. PATENT DOCUMENTS 3,306,168 A * 2/1967 Blumrick ..... 89/191
3,906,833 A * 9/1975 Orozco ..... 89/196
4,664,013 A * 5/1987 Wegner et al. ..... 89/6.5
4,711,152 A * 12/1987 Fortunko ..... 89/6.5
4,979,424 A * 12/1990 Becker et al. ..... 89/6.5
5,303,495 A * 4/1994 Harthcock ..... 42/84
5,320,023 A * 6/1994 Erdem ..... 89/195
5,343,795 A * 9/1994 Ziemba et al. ..... 89/6.5
5,421,264 A * 6/1995 Petrick
6,138,547 A 10/2000 Larsson et al.
6,170,377 B1 1/2001 Larsson et al.

FOREIGN PATENT DOCUMENTS

FR 850.572 * 12/1939 ..... 89/6.5

* cited by examiner

*Primary Examiner*—Stephen M. Johnson
(74) *Attorney, Agent, or Firm*—Foley and Lardner

(57) ABSTRACT

An open bolt firing mechanism for programmable cartridges. The mechanism includes a firing bolt having a bolt face configured to engage a programmable cartridge and force the programmable cartridge toward a barrel of the weapon. The mechanism also includes a cradle connected to the bolt for holding the programmable cartridge in a position adjacent to the bolt. The cradle stabilizes the cartridge so that fusing information may be transferred to the programmable cartridge.

12 Claims, 4 Drawing Sheets

OPEN BOLT FIRING MECHANISM FOR PROGRAMMABLE CARTRIDGES

CROSS REFERENCE TO RELATED APPLICATIONS

The present application claims priority to and the benefit of U.S. Provisional Patent Application Serial No. 60/277,944 filed Mar. 23, 2001 now abandoned. The foregoing provisional application is incorporated by reference herein in its entirety.

BACKGROUND OF THE INVENTION

The present invention relates to firing mechanisms for automatic firearms. In particular, the invention relates to an open bolt firing mechanism for use with programmable ammunition.

Ammunition typically includes a cartridge having a casing and a projectile. Projectiles are often composed of warheads and fuzes. Programmable ammunition receives data instructions that typically relate to the projectile's mode of operation. These modes of operation often include proximity and variable time modes of function. A proximity fuze initiates a detonation when the projectile reacts to an effect which is produced by a target (e.g. such as infrared radiation from a heat source, sound waves or radar reflection). A time fuze initiates a detonation after a certain flight duration. A variable time fuze may be set prior to firing.

Automatic firearms are designed to be fired repeatedly and continuously. In closed bolt mechanisms, cartridges are repeatedly moved into a firing chamber, where the cartridge is struck by a firing pin. Explosive retained in the casing explodes in the firing chamber causing the projectile to fire. As a result, the temperature of the firing chamber is raised to a point where there is a high risk of a cartridge "cooking off" in the chamber prior to being struck by the firing pin.

The risk of cook off has been reduced by the development of open bolt firing mechanisms. An open bolt firing mechanism holds the bolt in a retracted position after automatic firing, thereby preventing a live projectile from remaining in the hot firing chamber. In an open bolt firing mechanism, the projectile is typically fired while the bolt is moving forward toward the barrel. When the projectile is fired, recoil momentum is produced in the bolt. A portion of the recoil momentum is used to stop the forward movement of the bolt, and the remaining recoil momentum is used to return the bolt to its starting position.

Many firing mechanisms, both open and closed bolt, may be used to fire projectiles having electronic fuzes. U.S. Pat. Nos. 6,138,547 and 6,170,377 (incorporated by reference herein in their entirety) disclose cartridges having electronic programmable fuzes. In these shells (i.e., cartridges), programming pulses are transmitted to the fuzes from an external source. The shell may include an electrically conductive band for receiving the programming signals, as disclosed in the aforementioned patents. The programming pulses may be transferred to the band through direct galvanic contact or inductively. In a galvanic system, such as disclosed in U.S. Pat. No. 6,138,547, contact between the external source and the cartridge is made long enough for the programming information to be transferred. In an inductive method, such as disclosed in U.S. Pat. No. 6,170,377, the cartridge is placed in proximity to the external source allowing the programming information to be transferred inductively.

Some programmable cartridges include an energy storage device such as a capacitor that provides an initial supply of electrical power for the projectile to facilitate the transfer of data (programming) prior to set-back of the cartridge. Set-back occurs when the projectile is fired. The force of the projectile rapidly accelerating due to the expansion of gases in a barrel results in high acceleration (or set-back) forces in the projectile. At set-back, the rapid acceleration of the projectile through the barrel provides for the initiation of a continuous power supply during the flight of the projectile. It is desirable to minimize the size of the capacitor, because the size of the capacitor has a large effect on the cost of the cartridge. Capacitor size is related to the complexity of fuze components. One method of reducing the requirement for large capacitor size is to supply the programming information to the projectile late in the firing cycle in order to reduce the required data storage time and power requirements.

Programmable cartridges present special problems for open bolt firing systems. In an open bolt system, during automatic firing the bolt is constantly moving either toward or away from the barrel of the weapon. As the bolt moves forward to chamber the projectile in the barrel, the cartridge normally oscillates. As a result of the movement of the bolt and the associated oscillation, it is difficult to maintain consistent contact or proximity between the external source of the programmed pulses and the conductor located on the cartridge. To date this problem has prevented programmable ammunition from being used effectively with open bolt firing mechanisms. Thus, there is a need for a system or device that maintains the programmable shell or cartridge in a stable position so that programming information can be reliably transferred to the projectile, in order to permit programmable ammunition to be used with open bolt type automatic weapons. The present invention addresses this need and provides other advantages as discussed further below.

It is desirable, from a safety and system operation standpoint, to program the ammunition at the "point of no return". In other words, it is desirable that the ammunition is programmed after the operator pulls the trigger. This insures that the ammunition is programmed with the most recently obtained data. The present invention provides this advantage.

When using inductive setting, it is desirable to maintain close physical proximity between transmission and reception coils. It is also desirable to reduce physical oscillation between separated coils. The present invention provides this advantage. Further benefits of the present invention are discussed below.

SUMMARY OF THE INVENTION

According to one embodiment of the present invention, an open bolt firing mechanism for a weapon configured to fire a programmable cartridge is provided. The mechanism includes a firing bolt configured to force the programmable cartridge toward a barrel of the weapon, and a cradle for holding the programmable cartridge adjacent to the bolt. The cradle is configured to carry information for programming the cartridge.

Preferably, the cradle is adapted to move relative to the bolt. More preferably, the mechanism further comprises a biasing mechanism for biasing the bolt toward the barrel. The cradle may include a conductive surface for carrying information to be transferred to the programmable cartridge. Alternatively, the cradle may include a device for generating a magnetic field for transferring information to the programmable cartridge inductively.

According to another embodiment of the present invention, a method of programming a cartridge in a weapon having an open bolt firing mechanism is provided. The method includes the steps of positioning the programmable cartridge adjacent to a firing bolt located in a receiver in the weapon so that the cartridge is between the bolt and a barrel of the weapon, moving the bolt and the cartridge through the receiver toward the barrel of the weapon, and programming the cartridge prior to the cartridge moving away from the bolt.

Preferably, the step of positioning the programmable cartridge adjacent to a firing bolt includes placing the cartridge in a cradle connected to the bolt. More preferably, the step of programming the cartridge includes transferring information from the cradle to the cartridge at a point of contact between the cradle and the cartridge. Alternatively, the step of programming the cartridge includes transferring information to the cartridge inductively.

According to another embodiment of the present invention, a weapon having an open bolt firing mechanism configured to fire a programmable cartridge is provided. The weapon includes a bolt having a bolt face configured to contact the programmable cartridge and force the programmable cartridge toward a barrel of the weapon. A cradle is connected to the bolt for holding the programmable cartridge in a position adjacent to the bolt. The cradle is configured to transfer fusing information to the programmable cartridge prior to the cartridge leaving the bolt face.

Preferably, the weapon further comprises a mechanism for removing a spent casing from the weapon. The geometry of the cradle allows the casing to eject after the cradle extends from its retracted position flush with the bolt face. More preferably, the weapon further comprises a loading mechanism for positioning cartridges in the cradle. In a preferred embodiment, the cradle includes a conductive surface adapted to contact a conductor located on the programmable cartridge so that fusing information may be transferred to the programmable cartridge. Alternatively, the weapon further comprises a device for generating a magnetic field so that the fusing information may be inductively transferred to the programmable cartridge.

According to another embodiment of the present invention, a cradle for holding a programmable cartridge in a position adjacent to a bolt in a weapon having an open bolt firing mechanism is provided The cradle is configured to transfer fusing information to the programmable cartridge prior to the projectile being fired. Preferably, the cradle includes a conductive surface adapted to contact a conductor located on the programmable cartridge so that fusing information may be transferred to the programmable cartridge. Alternatively, the cradle may include a device for generating a magnetic field so that the fusing information may be inductively transferred to the programmable cartridge.

It is to be understood that both the foregoing general description and the following detailed description are exemplary and explanatory only, and are not restrictive of the invention as claimed.

BRIEF DESCRIPTION OF THE FIGURES

These and other features, aspects and advantages of the present invention will become apparent from the following description, appended claims and the accompanying exemplary embodiments shown in the drawings which are briefly described below and which constitute part of this specification.

DETAILED DESCRIPTION

The present invention may be used with any weapon utilizing an open bolt firing mechanism. For convenience, the present invention is described with reference to an automatic weapon such as, for example, an MK19 Grenade Machine Gun (also know as a MK19 Automatic Grenade Launcher). The MK19 is mentioned only for exemplary purposes and is not intended to limit the scope of the invention in any way.

Figure 1:
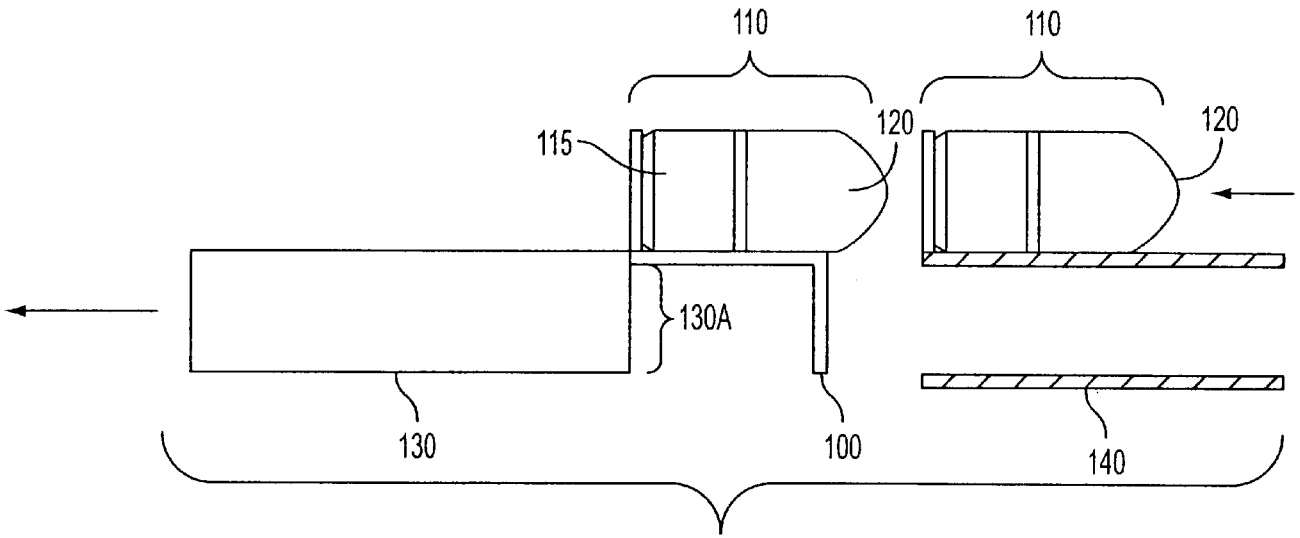
FIG. 1 is a cross-sectional side view of an open bolt firing mechanism according to the present invention showing the fuze cradle and the bolt in a rearward position.

As shown in FIG. 1, the present invention includes a fuze cradle 100 that supports the cartridge 110. Both parts of the cartridge 110 are supported. The projectile 120 is supported by the cradle 100 and the casing 115 is supported by the bolt face 130*a*. The bolt face 130*a* may include a notch or ridge for receiving the bottom of the casing.

Figure 4:
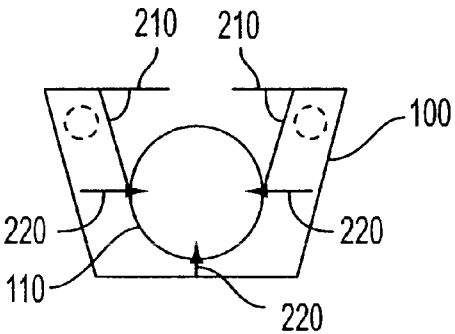
FIG. 4 is an end view of the fuze cradle showing a three connector pin contact between the fuze cradle and the fuze collar located on the cartridge.

As shown in FIG. 4, the cradle 100 makes galvanic contact with the cartridge 110 through contact pins 220 located at three different points. The cradle 100 may include a mechanism for retaining the cartridge 110 in the cradle 100. The retaining mechanism may include the horizontally extending retaining members 210 shown in FIG. 4. The retaining members 210 are biased upwardly into the position shown in FIG. 4. The retaining members 210 move out of the way to allow the cartridge 110 to be placed in the cradle 100 during the firing sequence.

Figure 2:
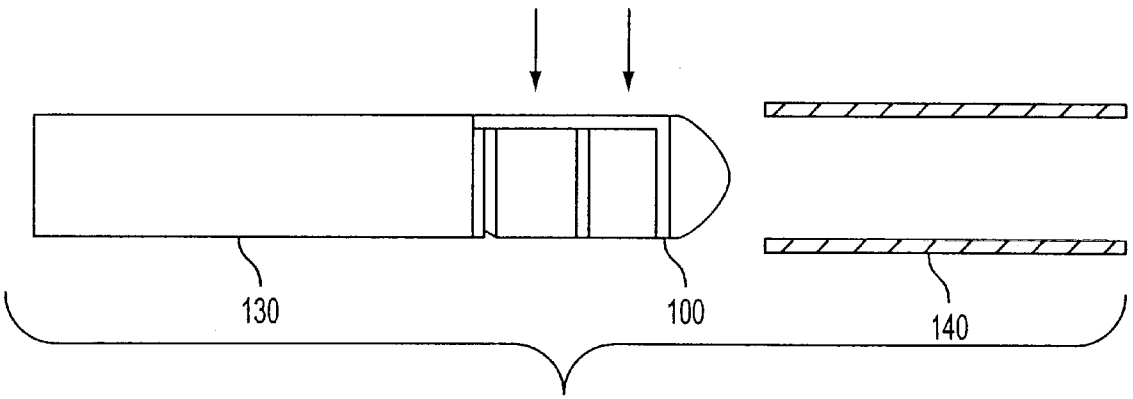
FIG. 2 is a cross-sectional side view of an open bolt firing mechanism according to the present invention showing the fuze cradle and the bolt in a "loaded" position.

FIG. 2 shows the bolt 130 at the rear of a housing for the firearm breech and firing mechanism (i.e., receiver). The receiver 400 is shown clearly in FIGS. 5 and 6. The cartridge 110 moves from a loading position as shown in FIG. 1, to a loaded position as shown in FIG. 2. When the operator depresses the firing trigger (and the weapon is set from the Safe to the Fire position) the bolt 130 is released to move forward inside the receiver in the direction of the barrel. In the firing position, shown in FIG. 3, the cradle is retracted flush with the bolt face allowing the cartridge to seat properly in the barrel.

As the cartridge 110 moves forward (FIG. 2), a sensor will send a synchronizing signal to the ammunition programming circuitry (not shown). A data bus may delay the leading edge of the synchronizing signal for a predetermined amount of time to ensure that the transferred energy (power) and data are stored in the projectile for a minimum period of time. By minimizing the energy storage period, minimum power is lost prior to the firing of the projectile. Further, minimizing the data storage time reduces the energy consumed in the programmed memory. This process may include a delay time of approximately 15–20 milliseconds in order to ensure that the synchronization is complete. After the prescribed delay, the data bus transmits the leading edge of the synchronizing signal to the projectile 120. The cradle 100 ensures that there is constant galvanic contact between the data bus and the projectile 120 during the period when information is being transferred. Alternatively, inductive rather than galvanic contact may be used to transfer programming information through the fuze cradle 100 to the projectile 120.

The cradle allows for the clean transmission of inductive fields between the fuze setting coils (located in the cradle) and the fuze (in the cartridge projectile). The physical proximity of fuze setter to projectile fuze is beneficial in reducing total power used to transmit signals, reducing projectile costs and in optimizing the mass used for fuze setters. After synchronization is complete, the bolt 130 moves the cartridge 110 toward the barrel of the weapon 140. The bolt normally strokes forward in approximately 75–100 milliseconds. Preferably the data bus is synchronized with the movement of the bolt 130 so that the fusing information is transferred to the projectile 120 at the latest possible moment.

Figure 3:
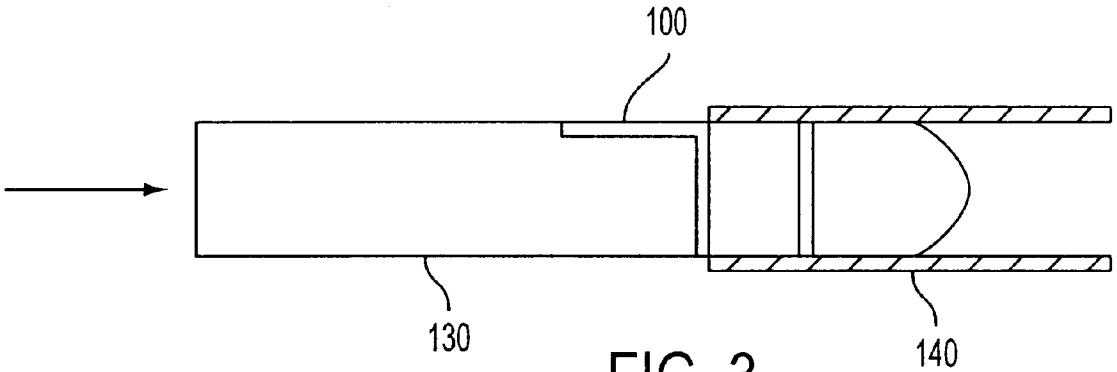
FIG. 3 is a cross-sectional side view of an open bolt firing mechanism according to the present invention showing the fuze cradle and the bolt in a "firing" position.

After the entire programming signal is transmitted to the projectile 120, the fuze cradle 100 may retract as it meets the front of the receiver, as shown in FIG. 3. The cradle 100 moves into the bolt 130 as the cartridge 110 is chambered into the barrel 140. When the fuze cradle of the present invention reaches the barrel of the weapon it takes approximately 8–15 milliseconds for the arms of the cradle to retract into the bolt. The projectile fires forcing the bolt 130 rearward. In the case of the MK19 example, the bolt returns to a rearward position after firing in approximately 75–100 milliseconds. The entire firing cycle lasts approximately 150–200 milliseconds.

Figure 5:
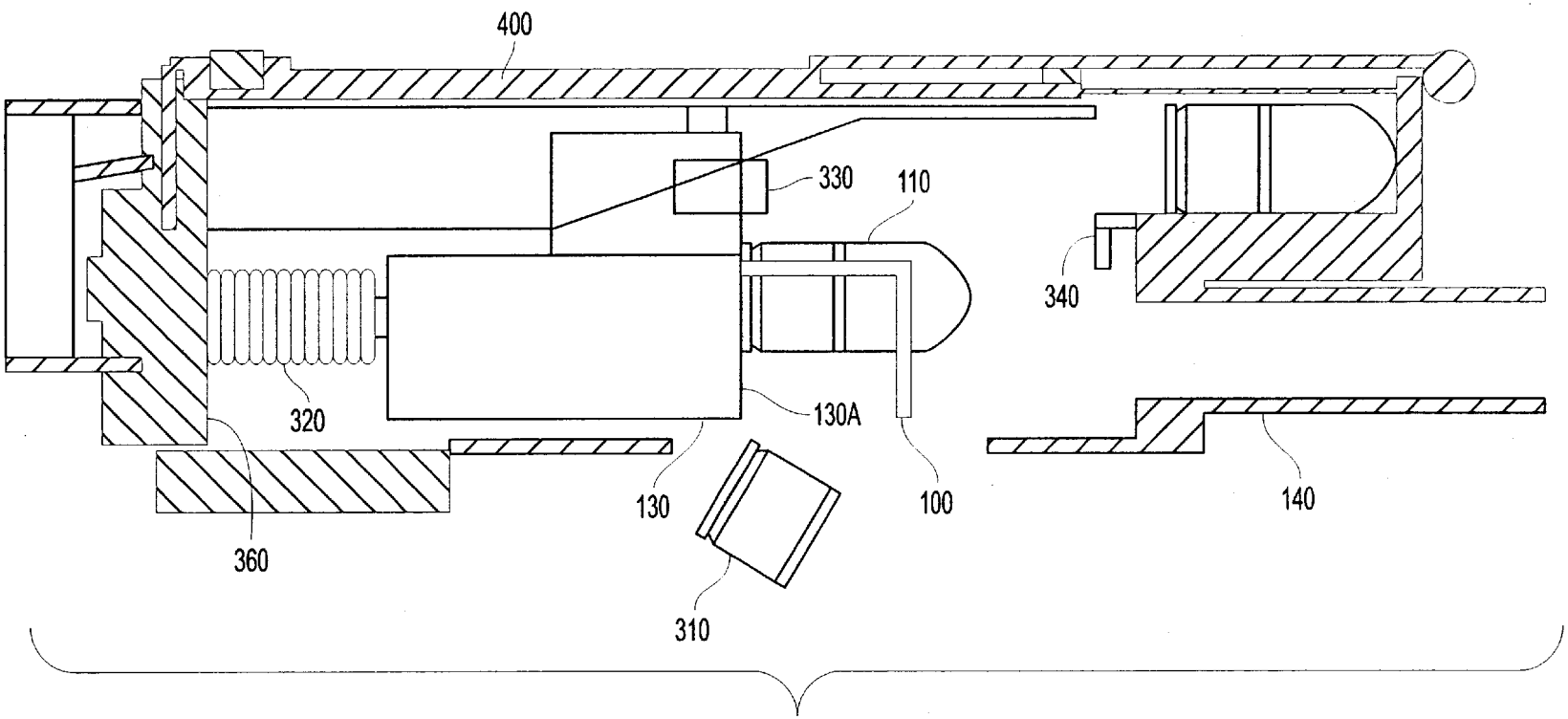
FIG. 5 is a side view of a weapon with an open bolt firing mechanism according to the present invention showing the loading of a cartridge into the cradle and the ejection of the spent cartridge case or casing.

Preferably, as shown in FIG. 5, the cradle 100 extends out from the bolt face 130A and the spent casing 310 is ejected from the receiver. The geometry of the cradle allows the cartridge to eject after the cradle extends from its retracted position flush with the bolt face. The cradle 100 is extended due to either the energy of a spring (or similar biasing mechanism) and/or by using a "catch" 340 between the receiver and cradle 100 that extends the cradle 100 as the bolt 130 moves rearward. During automatic firing mode, the next cartridge is moved into position.

During continued operation, the firing sequence continues to repeat until the last projectile is fired or until the operator releases the firing trigger. When the operator releases the trigger with the weapon's bolt 130 seared to the rear (FIGS. 2 and 5), the cartridge 110 positioned adjacent the bolt face 130A remains programmed with the burst time from the previous engagement. The bolt 130 or receiver housing 400 may include a sensor that provides a synchronizing signal upon release of the bolt sear or upon forward movement of the bolt 130. In particular, the sensor may be provided on the back plate 360 of the receiver 400.

A data hub or external fire control device may be provided to calculate programming information for transmission to the programmable cartridge 110. As described above, a synchronizing signal from a mechanical sensor allows for either an immediate or delayed transmission of the programming signal to the cartridge 110. The data transfer is complete just prior to the insertion of the fuze cradle 100 into the bolt 130 (i.e., upon cartridge chambering).

For the MK19 example of an automatic weapon, the firing mechanism described herein operates at a firing rate of approximately 325–375 projectiles per minute under ambient conditions. The corresponding time per stroke of the bore is approximately 150 to 200 milliseconds. It should be noted that the present invention is not limited to the MK19 and is suitable for use with other automatic weapons which may run at faster or slower rates than the MK19.

For an automatic weapon firing 40 mm ammunition (e.g., the MK19) the stroke length is approximately 1 meter. Thus, average velocity of the bolt is approximately 5–6.67 meters/second or 5–7 millimeters/millisecond.

Preferably, the bolt 130 is biased toward barrel 140 by a biasing mechanism which, in a preferred embodiment, is spring 320. As described above, the bolt 130 stops twice during each stroke. From a stationary position where the next cartridge is picked-up and the previous cartridge is fired, the bolt 130 moves rearward and is slowed down by spring 320 as energy is transferred to the collapsing spring. The bolt 130 then changes direction and the spring 320 expands to accelerate the bolt 130 forward. Assuming that the velocity of the bolt 130 increases constantly from zero until a terminal travel velocity just prior to the abrupt change of direction that occurs at firing, the actual speed of the projectile at the time it enters the barrel 140 should be double the average velocity of the bolt 130 as it travels through the receiver. Since the maximum average speed is 6 millimeters/millisecond the estimated speed at the point of the cartridge chambering should be about 12 millimeters/millisecond.

The required dwell time to both charge the capacitor and fire the projectile is approximately 25 milliseconds. The time required from the sync signal to the time pulses (i.e., the time when the capacitor charging and the transfer of programming and fusing information to the projectile begins) is approximately 8 milliseconds. Thus, the bolt travel distance during powering and data transfer to the projectile is approximately 96–300 millimeters. As with the stroke times above, the travel distances are merely provided for exemplary purposes and are not intended to limit the invention in any way.

Figure 6:
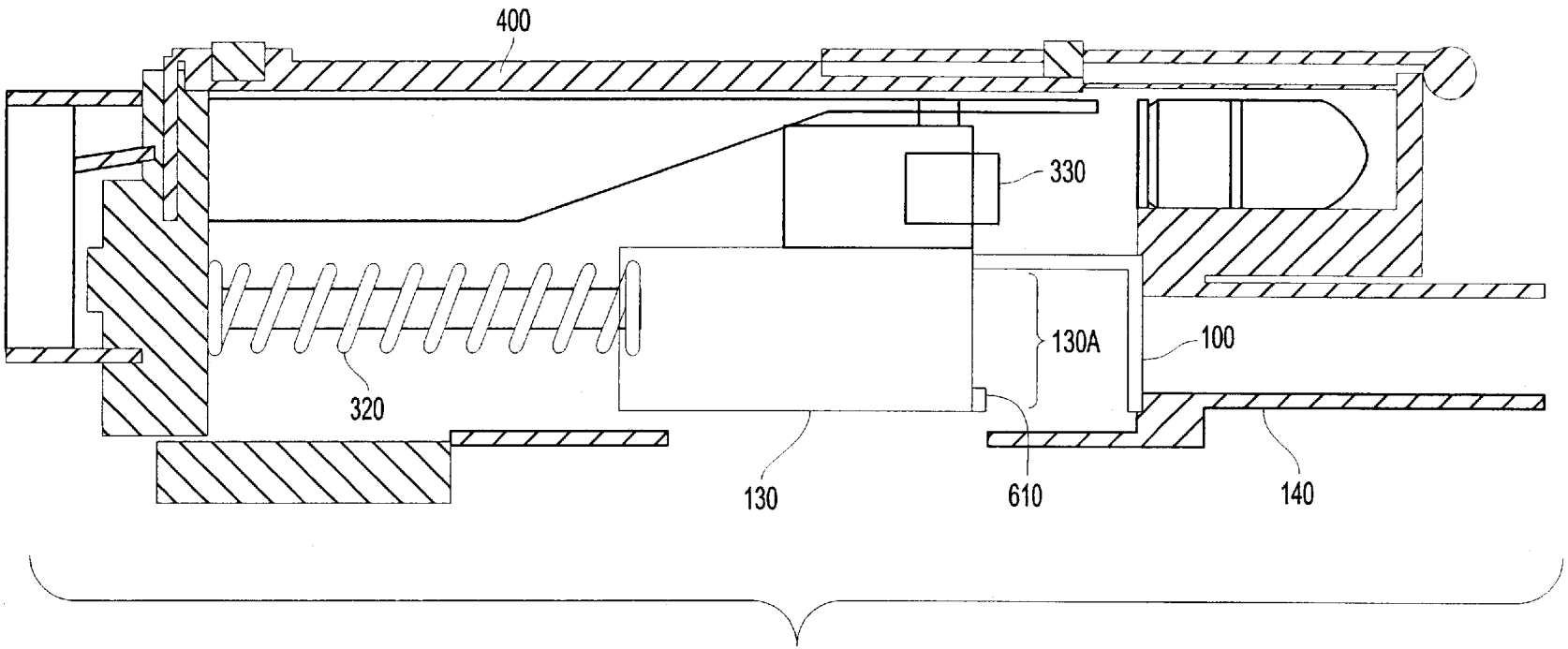
FIG. 6 is a side view of the weapon and open bolt firing mechanism of FIG. 5 showing the weapon in a charged condition with the cartridge positioned above the cradle.

As shown in FIG. 5 and FIG. 6, when the trigger is depressed the bolt 130 is released. Next, extractors 330 pick up the next cartridge from the ammunition supply. It is noted that any conventional ammunition feed system may be used in conjunction with the open bolt mechanism of the present invention. As described above, a support 610 for the casing 115 may be provided on the bolt face. The support may be a lip on the bolt face, a notch, a groove or any other support as would be readily apparent to one skilled in the art.

As shown in FIG. 5, the cartridge 110 may be pushed down the bolt face 130A into the cradle 100 using a cam assembly.

The firing mechanism described above may be provided in a retrofit kit for existing weapons to allow for loading fuzed and programmable ammunition in an open bolt automatic weapon.

Given the disclosure of the present invention, one versed in the art would appreciate that there may be other embodiments and modifications within the scope and spirit of the invention. For example, as an alternative, fusing information may be transferred from the bolt directly to the cartridge bypassing the cradle. The information may be received by the cartridge at the conductors located on the rear end of the shell casing. The information may be transmitted by either galvanic or inductive methods. Accordingly, all modifications attainable by one versed in the art from the present disclosure within the scope and spirit of the present invention are to be involved in further embodiments of the present invention. The scope of the present invention is to be defined as set forth in the following claims.

What is claimed is:

1. A method of a programming a cartridge in a weapon having an open bolt firing mechanism comprising the steps of:

positioning the programmable cartridge adjacent to a firing bolt located in a receiver in the weapon so that the cartridge is between the bolt and a barrel of the weapon;

moving the bolt and the cartridge through the receiver toward the barrel of the weapon; and programming the cartridge prior to the cartridge moving away from the firing bolts; and wherein the step of positioning the programmable cartridge adjacent to a firing bolt includes placing the cartridge in a cradle connected to the bolt.

2. The method of claim 1, further comprising the step of chambering the cartridge in the barrel.

3. The method of claim 1, wherein the step of programming the cartridge includes transferring information from the cradle to the cartridge at a point of contact between the cradle and the cartridge.

4. The method of claim 1, wherein the step of programming the cartridge includes transferring information to the cartridge inductively.

5. A weapon having an open bolt firing mechanism configured to fire a programmable cartridge comprising:

a bolt having a bolt face configured to contact the programmable cartridge and force the programmable cartridge toward a barrel of the weapon; and a cradle connected to said bolt for holding the programmable cartridge in a position adjacent to said bolt, wherein the cradle is configured to transfer fusing information to the programmable cartridge prior to the cartridge leaving the bolt face.

6. The weapon of claim 5, further comprising a loading mechanism for positioning cartridges in the cradle.

7. The weapon of claim 6, further comprising a biasing device for biasing the firing bolt toward the barrel of the weapon.

8. The weapon of claim 7, wherein the biasing device is a spring.

9. The weapon of claim 1, wherein the cradle is adapted to move relative to the bolt.

10. The weapon of claim 1, wherein the cradle includes a conductive surface adapted to contact a conductor located on the programmable cartridge so that fusing information may be transferred to the programmable cartridge.

11. The weapon of claim 1, further comprising a device for generating a magnetic field so that the fusing information may be inductively transferred to the programmable cartridge.

12. A method of a programming a cartridge in a weapon having an open bolt firing mechanism comprising the steps of:

positioning the programmable cartridge adjacent to a firing bolt located in a receiver in the weapon so that the cartridge is between the bolt and a barrel of the weapon;

moving the bolt and the cartridge through the receiver toward the barrel of the weapon; and programming the cartridge prior to the cartridge moving away from the firing bolt; and chambering the cartridge in the barrel of the weapon; and wherein the step of programming the cartridge occurs prior to the step of chambering the cartridge in the barrel.

* * * * *